US006962112B1

(12) United States Patent
Kern

(10) Patent No.: US 6,962,112 B1
(45) Date of Patent: Nov. 8, 2005

(54) ENTIRELY COMBUSTIBLE INDUCTIVE PRIMER

(75) Inventor: Heinz Kern, Fürth (DE)

(73) Assignee: Ruag Ammotec GmbH, Fuerth (DE)

( * ) Notice: Subject to any disclaimer, the term of this patent is extended or adjusted under 35 U.S.C. 154(b) by 382 days.

(21) Appl. No.: 10/048,168

(22) PCT Filed: Jul. 12, 2000

(86) PCT No.: PCT/EP00/06607

§ 371 (c)(1),
(2), (4) Date: Jun. 10, 2002

(87) PCT Pub. No.: WO01/09563

PCT Pub. Date: Feb. 8, 2001

(30) Foreign Application Priority Data

Jul. 30, 1999 (DE) ..... 199 36 095
Nov. 25, 1999 (DE) ..... 199 56 635

(51) Int. Cl.[7] ..... F42B 5/08; H01F 5/00; H01F 27/28

(52) U.S. Cl. ..... 102/472; 336/200; 336/225

(58) Field of Search ..... 102/472; 336/200, 336/225

(56) References Cited

U.S. PATENT DOCUMENTS 4,271,370 A * 6/1981 DiMeo ..... 310/266
4,639,708 A * 1/1987 Weatherly ..... 336/200
4,651,254 A * 3/1987 Brede et al. ..... 361/248
4,715,894 A * 12/1987 Holtzman et al. ..... 106/1.22
5,600,293 A * 2/1997 Hunter ..... 336/182

* cited by examiner

*Primary Examiner*—Harvey E. Behrend
*Assistant Examiner*—Bret Hayes
(74) *Attorney, Agent, or Firm*—Antonelli, Terry, Stout and Kraus, LLP.

(57) ABSTRACT

A pyrotechnical primer for igniting propellant powder for sleeveless ammunition comprises an igniting element (4) and a coil (1). The energy required for triggering is transmitted in an electromagnetic manner (inductively). The inductive primer is cost-effective, entirely combustible, easy to produce and is not provided with residues that damage the functioning of the weapons. The primer has a base construction such that the primer can be used in all conventional weapons calibres. To this end, the ignition element (4) and the coil (1) are located on a mutual, flat, combustible consumable or support material (5).

5 Claims, 2 Drawing Sheets

ENTIRELY COMBUSTIBLE INDUCTIVE PRIMER

BACKGROUND OF THE INVENTION

Figure 1:
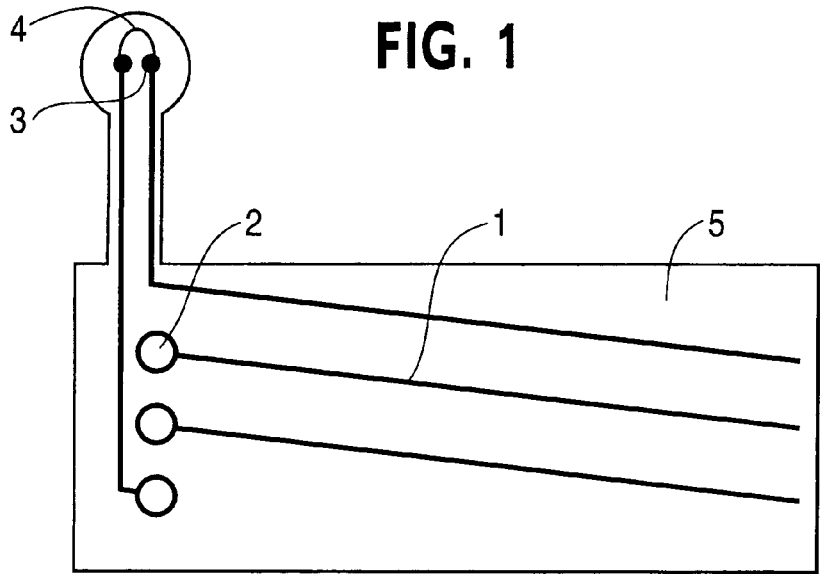

The invention relates to a pyrotechnic primer for igniting propellant powder for sleeveless ammunition, the primer having an ignition element and a coil, in which the energy required for triggering is transferred by electro-magnetic means (inductively).

The intensified requirement for the use of sleeveless ammunition in recent years has led increasingly to attempts at solutions comprising ignition systems which operate on the principle of transferring energy to the combustion chamber of a weapon without contact. Solutions demonstrating the principle of inductive ignition have been described in the past and their feasibility has been proved on various weapons systems.

The principal problem with previous design specifications for inductive primers has been with the non-combustible components of the receiving coil and the electrical ignition elements. This is particularly the case with relatively small calibre diameters because here unburned remains of the primer can form residues either in the cartridge chamber or in the barrel which will damage the weapon.

BRIEF SUMMARY OF THE INVENTION

The object of the invention is therefore to construct a fully combustible, inductive primer with a design which is simple and economical to manufacture, which does not produce any residues harmful to the functioning of the weapon and which is suitable for universal use with all current weapon calibres.

This problem is solved according to the invention in that the ignition element and coil are placed on a common, flat, combustible or consumable support material.

According to the invention, the entire support material of the primer consists of combustible or consumable materials such as e.g. paper or nitro-cellulose.

In a preferred embodiment, ends of conductors (printed circuit trace ends), which are in one plane, are laid one on top of the other and as a result of their contacting, a three-dimensional cylindrical coil is formed and, moreover, the remaining printed circuit trace ends forming connection surfaces (contact points) of the ignition bridge.

It is practical to apply the electrical printed circuit traces to the support material using screen-printing, the said traces consisting of silver or copper conductive paste.

The inductive primers can be of a columnar or flat design, consisting of a combustible or consumable electrical ignition element and an induction coil with several windings and any desired external geometry, which is applied to or embedded in a flat single or multi-layer, combustible, insulating support material, it being possible, also, for the electrically conductive coil material to be designed to be combustible or consumable.

It is advantageous for the entire inductive primer to be applied in one plane as a single layer or several layers onto a flexible, combustible paper or nitro-cellulose film or another combustible support layer, the entire electrical routing of the conductors or the printed circuit traces consisting, for example, of hardened silver or copper conductive paste or another metal composition or of non-metallic combustible or consumable conducting material, which is preferably applied using screen-printing or another application process.

The advantage of the above-mentioned invention is to be found in the fact that the inductive primer consists of a single component, which only attains its function as a result of shaping and through supply of incandescent wire, dots of conductive adhesive and the detonator unit, and that it is completely combustible or consumable.

BRIEF DESCRIPTION OF THE SEVERAL VIEWS OF DRAWINGS

Further characteristics of the invention are to be found in the figures, which are described below.

These show:

FIG. 1 an example of fabrication of a primer according to the invention

Figure 2:
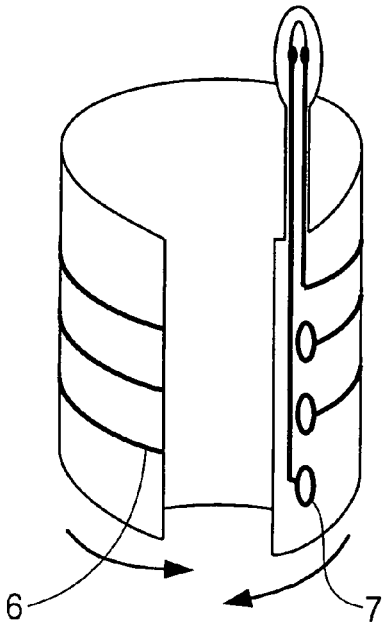

FIG. 2 the fabrication process concerned

Figure 3:
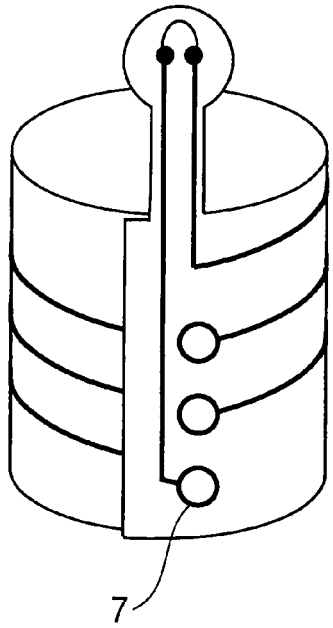

FIG. 3 the finished primer and

Figure 4:
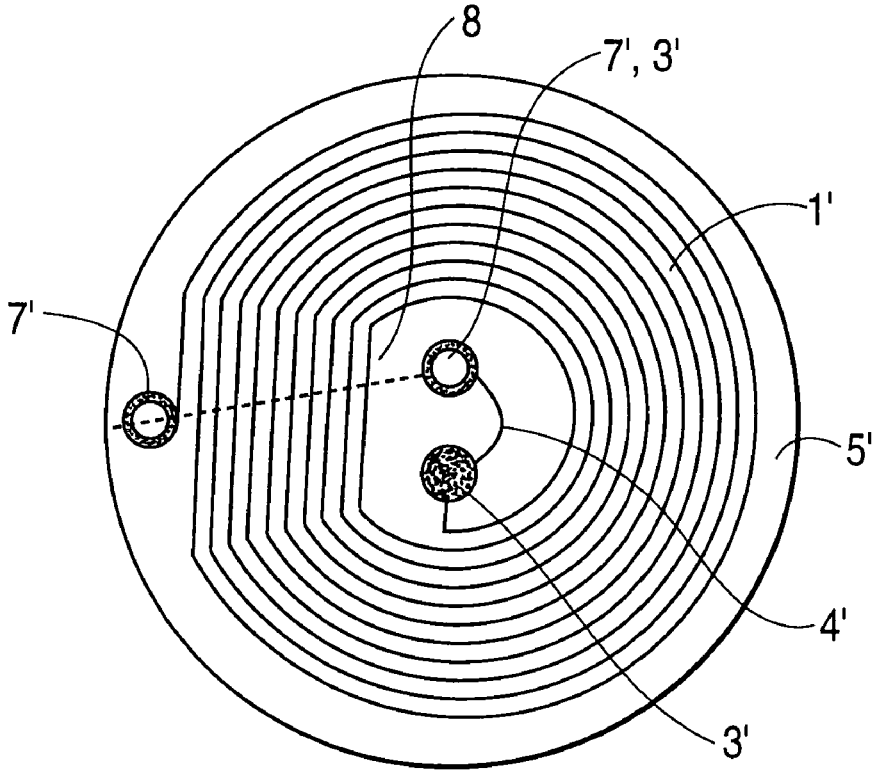

FIG. 4 an alternative example of a flat primer.

DETAILED DESCRIPTION OF THE INVENTION

FIG. 1 shows an example of fabrication of a cylindrical receiving coil on combustible support material 5 and printed circuit traces consisting of printed conductive paste with, for example, three windings 1 but without the through-contacts in place. The coil windings 1, the through-contact points 2, the connection point 3 for the incandescent ignition wire and the incandescent wire 4 are illustrated. The incandescent ignition wire can make the contact with the connection surfaces 3, for example, using adhesive or bonding. The geometry, conductor cross-section and number of windings 1 can vary within a broad framework.

FIG. 2 shows the fabrication process for achieving a cylindrical coil by laying the coil ends 6 together and then making contact between the coil ends 6 via the through-contacting points 7, preferably using electrically conductive adhesive. In addition, the ends of the paper 5 lying one on top of the other can be fixed with NC-adhesive.

FIG. 3 shows the primer ready for installation. Visible are the through-contacting points 7, through whose central hole the coil ends 6 make contact. The support material 5 around the contact surfaces 3 can be fixed in a suitable position in the ignition chain because of its flexibility and connected to a suitable combustible container to hold the ignition material e.g. using adhesive.

FIG. 4 shows an example of the fabrication of a flat receiving coil on combustible support material 5' and printed circuit traces made of printed conductive paste with, for example, ten windings. The coil windings 1', the through-contact points 7', the printed circuit traces on the back 8 of the support material 5' and the connection points 3' of the incandescent ignition wire 4' can be seen. The geometry, conductor cross-section and number of windings 1' can vary within a broad framework.

DESCRIPTION OF FUNCTIONING

When a pulse current impinges on a primary coil on the weapon side is struck by a pulse of current, an alternating magnetic field is generated and a voltage is induced in the coil of the inductive ignition element, which drives a current because of the electrical resistance of the incandescent wire, which, as a result of conversion into Joulean heat, causes ignition of the detonator unit and thus ignites the propellant powder.

All the components of the primer are burned or consumed during this process.

What is claimed is:

1. Pyrotechnic primer for igniting propellant powder for sleeveless ammunition, the primer having an ignition element and a coil in which the energy required for triggering is transferred by electromagnetic means (inductively), characterised in that the ignition element and the coil are situated on a common, flat support material, the entire support material consisting of combustible or consumable materials, and in that a three-dimensional cylindrical coil is produced by providing conductive tracks on the support material, rolling the support material to form a cylinder, and laying opposed conductor ends of the coil one on top of the other and making a contact between them, with remaining ends of printed circuit traces forming connection surfaces of the ignition element.

2. Primer according to claim 1, characterised in that the entire support material of the primer consists of paper or nitro-cellulose.

3. Primer according to claim 1, characterised in that the coil is applied to the support material by screen-printing silver or copper conductive paste.

4. Primer according to claim 1, characterised in that the entire support material comprises of paper.

5. Primer according to claim 1, characterised in that the entire support material comprises of nitro-cellulose.

* * * * *